US007775388B2

(12) United States Patent
Murrer, III

(10) Patent No.: US 7,775,388 B2
(45) Date of Patent: Aug. 17, 2010

(54) TRANSPORT CONTAINER FOR HAZARDOUS MATERIAL

(75) Inventor: Albert Andrew Murrer, III, Sinking Spring, PA (US)

(73) Assignee: Quest Diagnostics Investments Incorporated, Wilmington, DE (US)

( * ) Notice: Subject to any disclaimer, the term of this patent is extended or adjusted under 35 U.S.C. 154(b) by 791 days.

(21) Appl. No.: 10/629,322

(22) Filed: Jul. 28, 2003

(65) Prior Publication Data

US 2005/0023282 A1 Feb. 3, 2005

(51) Int. Cl.
*B65D 25/00* (2006.01)
*B65D 21/02* (2006.01)

(52) U.S. Cl. ..... 220/23.9; 220/9.4; 220/592.2

(58) Field of Classification Search ..... 220/4.28, 220/4.29, 6, 9.2, 9.3, 9.4, 23.9, 592.2, 592.23, 220/915.2; 206/545; 383/110, 111, 119
See application file for complete search history.

(56) References Cited

U.S. PATENT DOCUMENTS 1,181,829 A * 5/1916 Bower ..... 220/9.3
2,575,191 A 3/1948 Seipp
2,667,198 A 1/1951 Klein
3,460,740 A 8/1969 Hagen
4,196,817 A 4/1980 Moser
4,211,267 A 7/1980 Skovgaard
4,343,158 A 8/1982 Campbell
4,528,694 A 7/1985 Skovgaard
4,585,159 A * 4/1986 Travis ..... 229/166
4,865,899 A * 9/1989 Reichert ..... 428/189

(Continued)

FOREIGN PATENT DOCUMENTS

DE 3144702 5/1983

(Continued)

OTHER PUBLICATIONS

International Search Report dated Jan. 11, 2006 for PCT Application No. PCT/US04/24063.

*Primary Examiner*—Harry A Grosso
(74) *Attorney, Agent, or Firm*—Foley & Lardner LLP

(57) ABSTRACT

A container system and a method for transporting hazardous materials is disclosed. One embodiment of the container system includes a soft-sided outer shell and an inner frame. The outer shell is at least partially collapsible when unsupported. The outer shell may include a plurality of vertical walls integrally formed with a bottom and an open top. A lid may be adapted to be selectively secured to the vertical walls to close the outer shell. A fastener, such as a zipper, may be provided to secure the lid to the vertical walls. The inner frame has rigid walls and is adapted to support the outer shell when the inner frame is inserted inside the outer shell. The inner frame is at least partially collapsible. One embodiment of the method includes providing a soft-sided container that is at least partially collapsible when unsupported. Hazardous material is positioned into the container. The hazardous material supports the container from within and causes the container to assume an at least partially assembled configuration. In another embodiment of the method, a soft-sided outer shell that is at least partially collapsible when unsupported is provided. An inner frame is inserted into the outer shell. Hazardous material for transport, for example, is then positioned into the outer shell in an assembled configuration.

29 Claims, 3 Drawing Sheets

U.S. PATENT DOCUMENTS

| | | | | |
|---|---|---|---|---|
| 5,237,838 | A | 8/1993 | Merritt-Munson | |
| 5,476,184 | A * | 12/1995 | Hill | 220/9.2 |
| 5,620,069 | A * | 4/1997 | Hurwitz | 190/107 |
| 6,139,188 | A | 10/2000 | Marzano | |
| 6,336,340 | B1 | 1/2002 | Laby | |
| 6,336,342 | B1 * | 1/2002 | Zeddies | 62/457.2 |
| 6,582,124 | B2 * | 6/2003 | Mogil | 383/110 |
| 6,609,628 | B2 * | 8/2003 | Tattam | 220/592.26 |
| 6,631,801 | B2 * | 10/2003 | Boyd-Moss et al. | 206/204 |
| 2001/0019024 | A1 | 9/2001 | Boyd-Moss et al. | |
| 2001/0030194 | A1 | 10/2001 | Tattam | |
| 2003/0106895 | A1 * | 6/2003 | Kalal | 220/9.2 |
| 2003/0136702 | A1 * | 7/2003 | Redzisz et al. | 206/545 |

FOREIGN PATENT DOCUMENTS

| | | |
|---|---|---|
| WO | WO 0218210 A1 * | 3/2002 |

* cited by examiner 120
100

BIO HAZARD
114
111
122
116
118
110
112
113
130
131
132
134

120
110
114
111
118
122

112
113

TRANSPORT CONTAINER FOR HAZARDOUS MATERIAL

FIELD OF THE INVENTION

The invention relates, in general, to containers. More particularly, the invention provides containers that may be used to efficiently transport material such as bio-hazardous material.

BACKGROUND

The following discussion of the background of the invention is merely provided to aid the reader in understanding the invention and is not admitted to describe or constitute prior art to the present invention.

Transportation of material often requires specialized packaging to ensure security of the material being transported as well as safety for personnel handling the material. For example, the transport of biohazardous material, such as organs for transplant patients, requires that the material be maintained in an environment suitable to prevent contamination of the material, as well as to ensure safety of handlers of the material. In this regard, materials such as organs are typically placed in hardened containers that may be thermally insulated. The thermal insulation ensures that the material, which is often maintained at refrigeration-level temperatures, are suitable for their intended use upon delivery. The hardening of the containers ensures that the materials are not released to the external environment, thereby posing a threat to personnel in the vicinity. In this regard, the containers must be sufficiently insulated to satisfy standards relating to ability to withstand impacts from falls, for example.

The insulated containers, however, represent a significant waste in cargo space when they are empty. For example, once an organ has been delivered to its intended destination, the empty container is usually returned to its original source. During the return trip, the empty container occupies the same amount of cargo space in, for example, a cargo airplane as the full container. An alternative to occupying the valuable cargo space is to dispose of the empty container. However, this can be an expensive proposition since such containers are typically specially constructed for a particular use and can represent a significant investment.

SUMMARY OF THE INVENTION

The disclosed devices are directed to containers and methods of transporting material using such containers. The containers provide the advantage of occupying substantially less space when they are empty than when they are full.

In one aspect, the invention provides a method for transporting hazardous material. According to the method, a soft-sided container is provided, the container being at least partially collapsable when unsupported. Hazardous material is positioned into the container. The hazardous material supports the container from within and causes the container to assume an at least partially assembled configuration.

"Transporting" refers to moving of an object from one location to another. In one example, transporting includes the use of an aircraft.

"Hazardous material" refers to products or materials which may pose a safety or health hazard. For example, hazardous material may include medical-related material such as biohazards. Hazardous material may include organs or other body parts or radioactive material. The hazardous material may be placed within another package prior to being positioned within the container.

As used herein, "soft-sided" refers to a non-rigid characteristic. "Soft-sided" may include a surface that can be, for example, bent or folded, either easily or with relatively little force.

As used herein, a "container" refers to a receptacle capable of retaining a material. The container may be configured as a rectangular box or may be of other useful configurations, such as a hexagonal box.

As used herein, "collapsable" means the ability to occupy less volume. "Collapsable" may include an organized reduction in volume through folding, for example, and may also include an unorganized reduction, as may occur with an unsupported structure. "At least partially" collapsable refers to the ability to collapse at least part of the way between a fully assembled configuration and a fully collapsed configuration.

As used herein, "positioning" refers to placing of material within the container. "Positioning" may include placing the material either loosely within the container or may include using inserts to prevent undesired movement of the material within the container.

As used herein, "assembled" refers to a configuration in which the container is uncollapsed. In either a partially assembled or a fully assembled configuration, a container may be capable of retaining material therein.

In a preferred embodiment, the soft-sided container satisfies IATA 602 requirements for outer packaging. "IATA 602", as used herein, refers to "Packing Instruction 602-Infectious substances" published by the International Air Transport Association (IATA), which are more completely described below. "Outer packaging" is described within IATA 602.

In a preferred embodiment, the soft-sided container includes vent holes. Vent holes may be provided to allow gases to be vented from within the container to the atmosphere.

The method may further include removing the hazardous material from the container and collapsing the container.

In another aspect, the invention provides a container system including a soft-sided outer shell and an inner frame. The outer shell is at least partially collapsable when unsupported, and the inner frame has rigid walls. The inner frame is adapted to support the outer shell when the inner frame is inserted inside the outer shell. The inner frame is at least partially collapsable.

As used herein, a "container system" refers to a system capable of retaining a material. The system may include a container such as a rectangular box or may be of other useful configurations, such as a hexagonal box. The container may be provided in combination with other structures or elements.

An "outer shell" refers to a portion of a container system including its external surface. The outer shell may include a bottom, plurality of walls and a lid. An "inner frame" is a support frame for supporting the outer shell from within.

In a preferred embodiment, the outer shell satisfies IATA 602 requirements for outer packaging when supported from within by the inner frame.

In a preferred embodiment, the outer shell includes a plurality of vertical walls integrally formed with a bottom and an open top. The outer shell also includes a lid adapted to be selectively secured to the vertical walls to close the outer shell. A fastener may be provided to secure the lid to the vertical walls. In a most preferred embodiment, the fastener is a zipper. The bottom may be structurally reinforced.

The outer shell may include an outer fabric layer and foam insulation for thermally insulating an interior of the shell from an external environment. The outer fabric may include polyester.

In a preferred embodiment, the inner frame may include a pair of opposing, rigid longitudinal walls and a pair of opposing, collapsable side walls. Each of the side walls may link an end of one of the longitudinal walls to an end of the other of the longitudinal walls. The side walls may be adapted to collapse to allow a reduction in a distance between the longitudinal walls. In a most preferred embodiment, the inner frame also includes a rigid bottom pivotably engaged to one of the pair of opposing rigid walls. The rigid bottom is adapted to selectively pivot between a first open position and a second collapsed position. The inner frame may also include a fastener to secure the side walls in a collapsed position.

In another aspect, the invention provides a method for transporting hazardous material. According to the method, a soft-sided outer shell is provided, the outer shell being at least partially collapsable when unsupported. An inner frame is inserted into the outer shell, the inner frame having rigid walls and being adapted to support the outer shell in an assembled configuration. Hazardous material is positioned into the outer shell in an assembled configuration.

The method may further include removing the hazardous material from the outer shell, removing the inner frame from the outer shell, collapsing the inner frame, and collapsing the outer shell. In this regard, an empty container can be efficiently returned to its source while occupying significantly less cargo space.

BRIEF DESCRIPTION OF THE DRAWINGS

In the following, the invention will be explained in further detail with reference to the drawings, in which.

DESCRIPTION OF CERTAIN EMBODIMENTS OF THE INVENTION

The disclosed embodiments of the present invention provide a container system for transporting material, such as biohazards, and methods of transporting such materials in a safe and efficient manner. In particular, the system and methods of the present invention allow transportation of hazardous material, while reducing the amount of cargo space used by a transport container when the container is empty.

Figures 1, 2, 3:
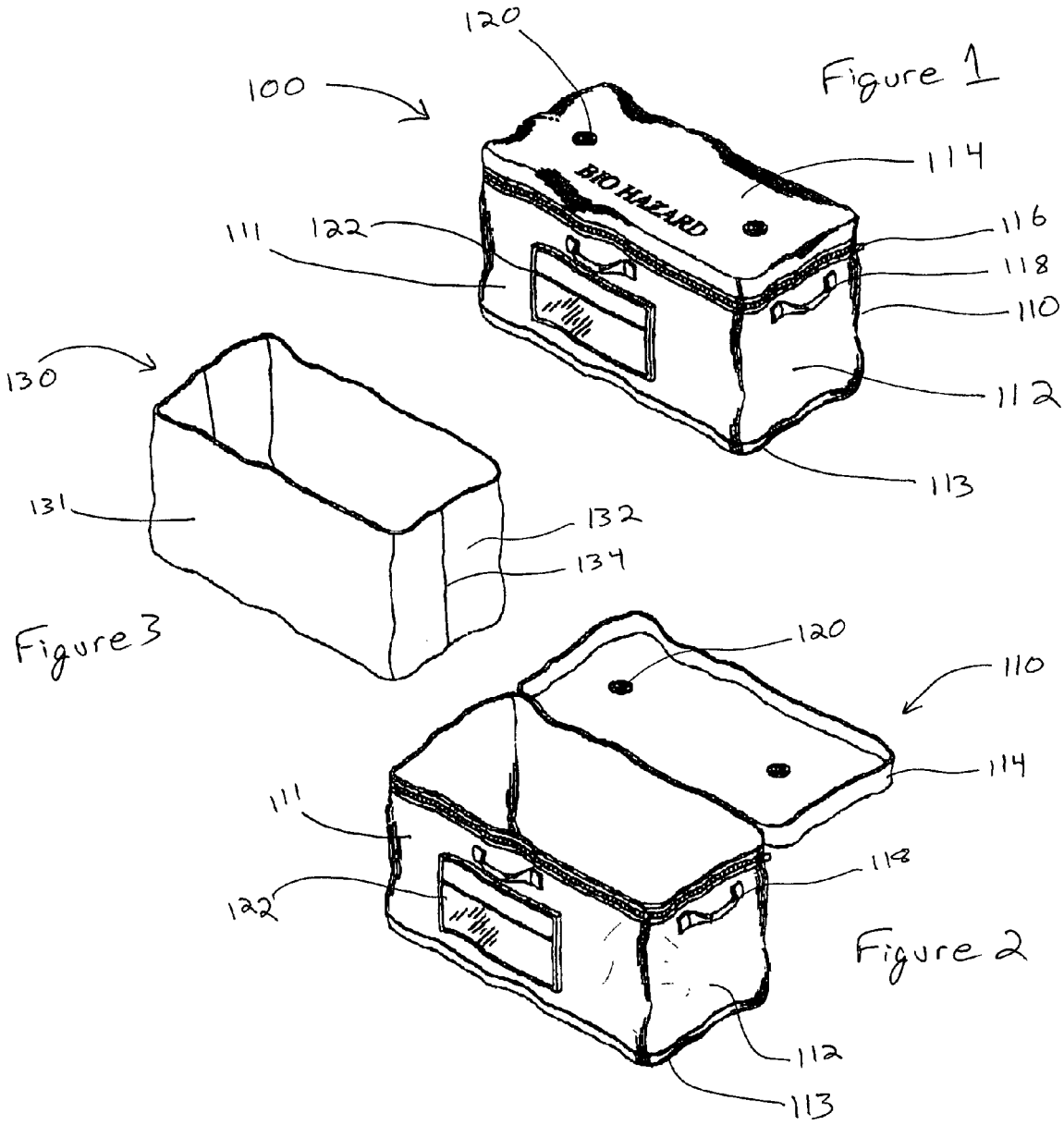
FIG. 1 illustrates an embodiment of a container system according to the present invention.
FIG. 2 illustrates an embodiment of an outer shell of the container system illustrated in FIG. 1.
FIG. 3 illustrates an embodiment of an inner frame of a container system according to the present invention.

FIG. 1 illustrates an embodiment of a container system according to the present invention. The container system 100 includes an outer shell 110 that is configured as a rectangular box, as illustrated in FIGS. 1 and 2. The dimensions of the rectangular box may be selected for the desired application. In the preferred embodiment, the rectangular box is 21 inches long, 12 inches wide and 15 inches high. Of course, configurations other than a rectangular box may also be used. For example, a hexagonal box may be used for certain applications.

The outer shell 110 includes a plurality of walls, including a pair of opposing longitudinal walls 111 separated by a pair of opposing side walls 112. The walls 111, 112 form the outer structure of the container system 100. The longitudinal walls 111 and the side walls 112 are formed of a pliable material, such as a fabric or a non-rigid plastic, which allows the walls 111, 112 to be flexible and collapsable.

In a preferred embodiment, the longitudinal walls 111 and the side walls 112 are formed of a fabric layer, an inner liner and a foam insulating layer therebetween. The fabric layer, the outermost layer, is preferably made of a rugged fabric, such as 600 Denier polyester with a PVC backing. The fabric layer should be of a thickness sufficient to provide protection against puncturing or tearing. In this regard, the polyester fabric layer is preferably at least 0.05 mm thick.

The inner layer is preferably formed of a material that is watertight to prevent exposing materials in the container system 100 to the external environment. In one embodiment, a heavy-duty vinyl material may be used. As with the outer fabric layer, the inner layer should be sufficiently strong to resist punctures or tearing. In one embodiment, the inner layer has a thickness of 0.64 mm.

The foam layer between the fabric layer and the inner layer serves at least two functions. First, it provides thermal insulation between the interior of the outer shell 110 and the external environment. This can be a critical function, for example, when the container system 100 is used for transport of human organs. The organs must be maintained at a refrigerated temperature. Typically, dry ice or other cooling elements may be used to maintain this temperature. Transport times may be long, and the dry ice may be effective for an insufficient length of time without the thermal insulation.

Second, the foam layer serves to provide a cushioning effect to protect the contents of the container system 100 in the event of unexpected jarring or impacts. For example, regulations for certification of packaging of infectious substances require the package to withstand a 9-meter drop. The cushioning provided by the foam layer allows satisfaction of such requirements. In a preferred embodiment, the foam layer in the walls 111, 112 of the outer shell 110 is 20 mm thick.

The outer shell 110 also includes a reinforced bottom 113. The bottom 113 may be formed of the same materials and layers as the walls 111, 112, but preferably includes further reinforcement. In the preferred embodiment, the reinforcement includes increasing the thickness of the foam layer from 20 mm to 30 mm. This provides additional cushioning in the region most likely to experience impacts and vibrations. The reinforcements may also include a webbing material to protect against puncturing or tearing. The webbing material may also provide a surface with a greater coefficient of friction to reduce undesired movements of the container system 100. In the preferred embodiment, the webbing material is a PVC material of 1-mm thickness.

The outer shell 110 also includes a lid 114 which may be selectively opened and closed using a fastener, such as a zipper 116. The lid 114 is rectangular in shape and is sized to cover a volume formed by the walls 111, 112, and is preferably made of the same materials and layers as the walls 111, 112. The zipper 116 is formed to open the lid by detaching it from three of the four walls 111, 112. In a preferred embodiment, the zipper is formed of #8 Nylon coil with a metal pull.

The lid 114 is provided with vent holes 120 to prevent pressure buildup within the container system 100. Pressure may build up from, for example, evaporating dry ice or changes in altitude if the container system 100 is transported aboard an airplane. The vent holes 120 are preferably formed of breathable grommets to prevent exposure of the contents of the container system 100 to the external environment.

The outer shell 110 may be provided with handles 118 to facilitate carrying of the container system 100. Handles may be provided on two or more sides of the outer shell 110.

Additionally, a pouch 122 may be provided on one wall 111 of the outer shell 110 in which documents relating to the contents, source and destination of the container system 100 may be stored. The pouch 122 may be secured to the wall 111 through a hook-and-loop arrangement such as Velcro™.

Figure 4:
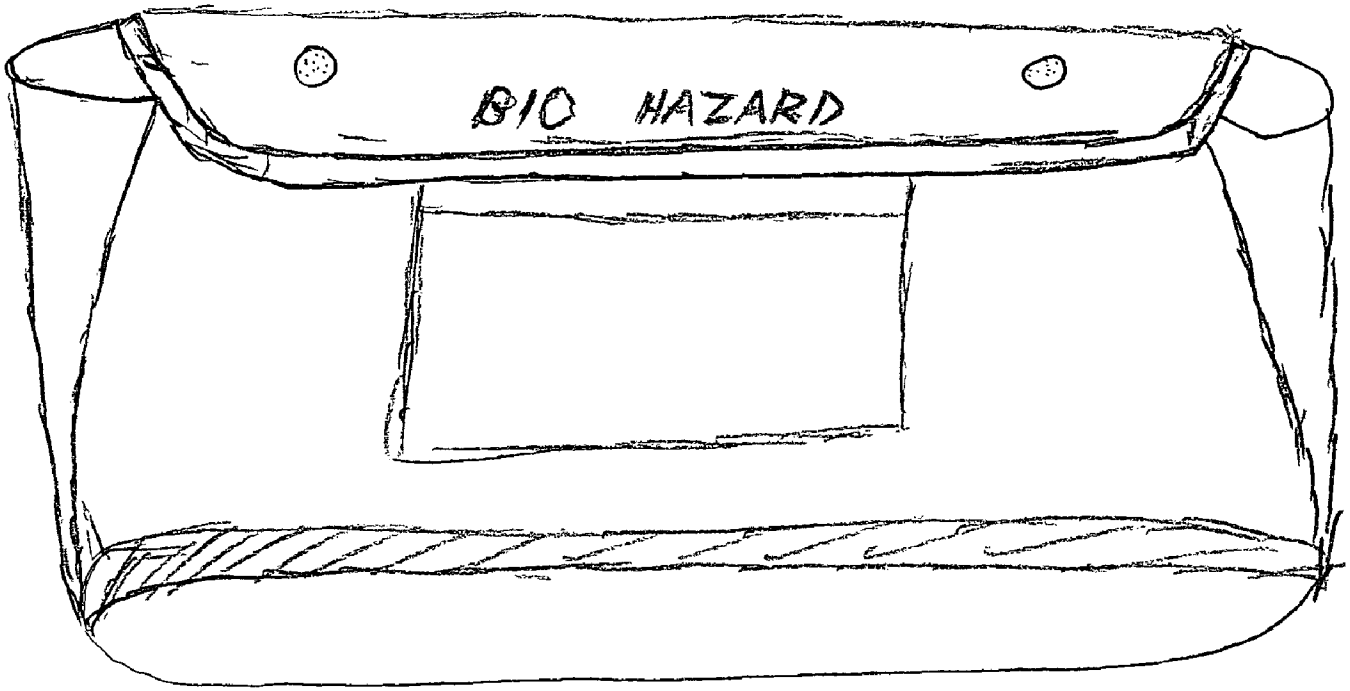
FIG. 4 illustrates the outer shell of FIG. 2 in a partially collapsed configuration.

When unsupported, the outer shell 110 may be collapsed to occupy significantly less volume, or cargo space, than in its uncollapsed configuration. FIG. 4 illustrates the outer shell in a partially collapsed configuration. In one embodiment, the outer shell 110 serves as the container for transporting hazardous material. Thus, the partially collapsed configuration illustrated in FIG. 4 can be achieved when the container 110 contains hazardous material, and a further collapsed configuration is achieved when the container is empty. In this embodiment, the collapsable container 110 is supported from within when hazardous material is positioned inside. Typically, the hazardous material includes packaging which is independently sealed or protected. Thus, the hazardous material can be positioned inside, and the bag can collapse to occupy approximately the minimum amount of space required by the hazardous material, rather than the full volume required by the rectangular box illustrated in FIG. 2, for example. In this regard, the container 110 not only conserves cargo volume when empty, but also while it is partially filled.

An embodiment of the container 110 satisfies all requirements for certification for transportation of such material, including satisfaction of drop tests. For example, the container 110 satisfies requirements for certification by meeting standards set for outer packaging in the International Airline Transportation Authority's Packing Instruction 602 (Infectious Substances) (IATA 602), which is hereby incorporated herein by reference and is provide at the end of this document.

During testing of one embodiment of the container 110, various U.S. Department of Transportation tests were conducted. The tests are specified in 49 C.F.R. §178. The tests involved dropping, puncturing, shocking, vibrating and pressurizing the container. The following results were achieved for each of these tests:

| DOT Test | Test Level | Test Result |
|---|---|---|
| −18° C./Drop | 9 m | Pass |
| Dry Ice Drop | 9 m | Pass |
| Puncture | 1 m | Pass |
| Thermal Shock | −40° C. to +55° C. | Pass |
| Vibration | 4.3 Hz | Pass |
| Pressure | 28 in Hg | Pass |

In another embodiment, when the container system 100 is required to be used for transporting materials, the outer shell 110 is structurally supported. In this regard, the container system 100 includes an inner frame 130, illustrated in FIG. 3. The inner frame 130 includes a pair of opposing longitudinal walls 131 which correspond to the longitudinal walls 111 of the outer shell 110. Additionally, the inner frame 130 includes a pair of side walls 132 separating the longitudinal walls 131. The side walls 132 correspond to the side walls 112 of the outer shell 110. In one embodiment, the side walls 132 include a crease 134 vertically bisecting each wall 132. The crease 134 allows folding of the wall 132 onto itself, as described below with reference to FIGS. 5A-5D.

Referring again to FIG. 3, the walls 131, 132 of the inner frame 130 are sized such that the inner frame 130 fits within the walls 111, 112 of the outer shell 110 in the fully uncollapsed configuration of the outer shell 110. In a preferred embodiment, the inner frame 130 also includes a bottom 136 (FIGS. 5A-5D).

The walls 131, 132 and the bottom 136 are each formed to retain a flat configuration. In one embodiment, the walls 131, 132 and the bottom are formed of plastic panels covered with a vinyl fabric. Other materials, such as cardboard or sheet metal, may also be used to form the panels.

For transporting of materials, the inner frame 130 is inserted into the outer shell 110 to provide structural support. With the inner frame 130 supporting the outer shell 110, the container system 100 provides a container for safe and secure transportation of hazardous material, such as biohazards. An embodiment of the container system 100 satisfies all requirements for certification for transportation of such material, including satisfaction of drop tests.

Once the materials have been delivered to their intended destination, the empty container system 100 can be collapsed to occupy significantly less volume than a typical container. The inner frame 130 can be removed from the outer shell 110, allowing the outer shell to be collapsed. The inner frame 130 can be separately collapsed, as illustrated in FIGS. 5A-5D.

Figure 5A:
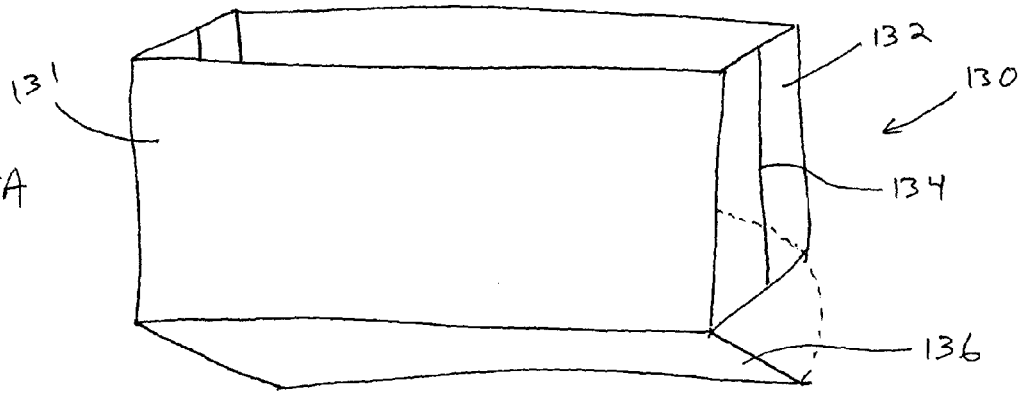
FIGS. 5A-5D illustrate the collapsing of an embodiment of an inner frame according to the present invention.

FIG. 5A illustrates the inner frame 130 described above and shown in FIG. 3. The inner frame 130 includes a pair of longitudinal walls 131 separated by a pair of side walls 132. Each side wall 132 is provided with a vertical crease 134 bisecting the side wall 132. A bottom 136 is provided in the form of a flap extending from the bottom edge of one of the two longitudinal walls. The bottom 136 can pivot about one edge, as illustrated by the dotted arc. In the fully expanded configuration, the bottom is in a position perpendicular to the walls 131, 132.

Figure 5B:
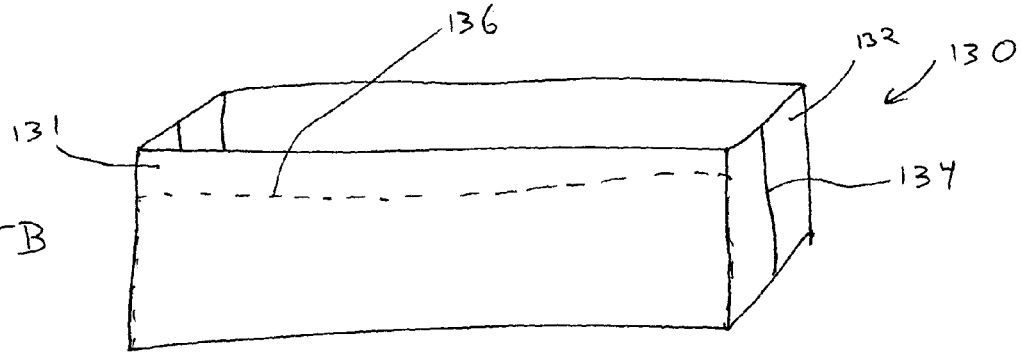
Figure 5C:
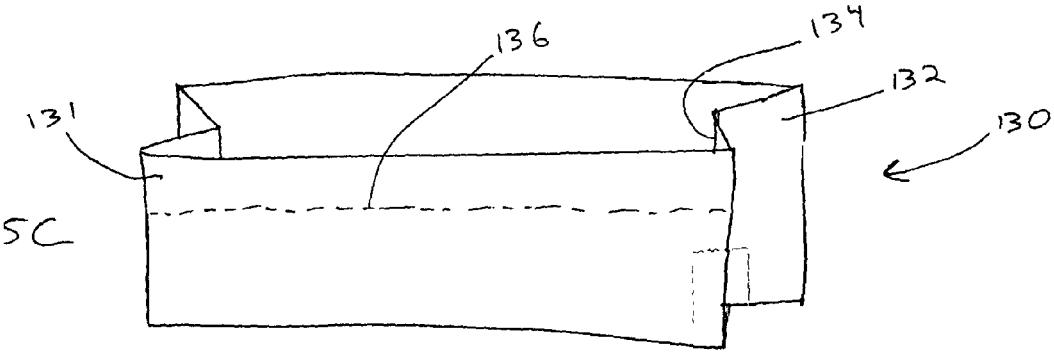
Figure 5D:
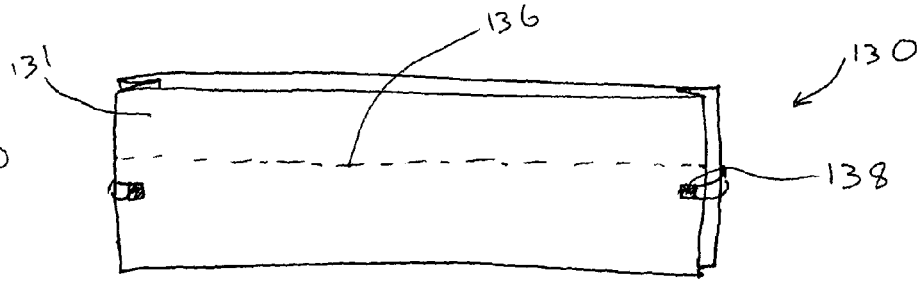

In order to collapse the inner frame 130, the bottom is pivoted up to a position parallel and adjacent to one of the longitudinal walls 131, as illustrated in FIG. 5B. Now, each side wall 132 can be folded along the vertical crease 134, with the crease 134 being pressed inward, as shown in FIG. 5C. Once the side walls 132 are folded, the bottom 136 is securely held in place in its vertical, folded position. With the side walls 132 completely folded, as shown in FIG. 5D, fasteners such as hook-and-loop arrangements 138 can be used to secure the opposing longitudinal walls 131 to each other in the collapsed configuration. Thus, the inner frame 130 can be collapsed into a thin structure occupying very little of the valuable cargo space.

Thus, the invention provides for efficient, safe and secure transportation of materials and return of containers.

While particular embodiments of the present invention have been disclosed, it is to be understood that various different modifications and combinations are possible and are contemplated within the true spirit and scope of the appended claims. There is no intention, therefore, of limitations to the exact abstract or disclosure herein presented.

IATA 602

General Requirements

Shippers of infectious substances must comply with these Regulations and must ensure that shipments are prepared in such a manner that they arrive at their destination in good condition and that they present no hazard to persons or animals during shipment. The packaging must include:

(a) inner packagings comprising:

a watertight primary receptacle(s)

a watertight secondary packaging, other than for large body parts and whole organs which require special packaging, an absorbent material which must be placed between the primary receptacle(s) and the secondary packaging. Absorbent material is not required for solid substances.

Multiple primary receptacles placed in a single secondary packaging must be wrapped individually or for infectious substances transported in liquid nitrogen, separated and supported to ensure that contact between them is prevented.

The absorbing material, for example cotton wool, must be sufficient to absorb the entire contents of all primary receptacles.

(b) an outer packaging of sufficient strength meeting the design type tests found in Subsection 6.5 and bearing the Specification Markings as required by 6.0.6 for shipments of infectious substances other than those containing large body parts and whole organs which require special packaging. Also infectious substances shipped on liquid nitrogen in packagings that meet the requirements of Packing Instruction 202 are excluded from the testing requirements of Subsection 6.5 and the marking requirements of 6.0.6.

Note: Packagings of the type known as a "dry shipper" (see Appendix A) when used to ship infectious substances must meet the testing requirements of Subsection 6.5 and the marking requirements of 6.0.6.

Packages must be at least 100 mm (4 in) in the smallest overall external dimension.

For all packages containing infectious substances other than those containing large body parts or whole organs which require special packaging, an itemized list of contents must be enclosed between the secondary packaging and the outer packaging.

The primary receptacle or the secondary packaging used for infectious substances must be capable of withstanding, without leakage, an internal pressure which produces a pressure differential of not less than 95 kPa (0.95 bar, 13.8 lb/in$^2$) in the range of −40° C. to +55° C. (−40° F. to 130° F.).

All packages containing infectious substances must be marked durably and legibly on the outside of the package with the NAME and TELEPHONE NUMBER OF A PERSON RESPONSIBLE FOR THE SHIPMENT.

Shipments of Infectious Substances of Division 6.2 require the shipper to make advance arrangements with the consignee and the operator to ensure that the shipment can be transported and delivered without unnecessary delay. The following statement required by 8.1.6.11.3 must be included in the Additional Handling Information area o the Shipper's Declaration:

"Prior arrangements as required by the IATA Dangerous Goods Regulations 1.3.3.1 have been made."

Specific Requirements

Although in exceptional cases, for example, the shipment of large body parts and whole organs, may require special packaging, the great majority of infectious substances can and must be packed according the following requirements:

Substances shipped at ambient or higher temperatures: Primary receptacles may only be of glass metal or plastic. Positive means of ensuring a leak-proof seal must be provided, such as heat seal, skirted stopper or metal crimp seal. If screw caps are used, these must be reinforced with adhesive tape.

Substances shipped refrigerated or frozen (wet ice, prefrozen packs, Carbon dioxide, solid [dry ice]): Ice, Carbon dioxide, solid (dry ice) or other refrigerant must be placed outside the secondary packaging(s) or alternatively in an overpack with one or more complete packages marked in accordance with 6.0.6. Interior support must be provided to secure the secondary packaging(s) in the original position after the ice or Carbon dioxide, sold (dry ice) has been dissipated. If ice is used, the packaging must be leak-proof. If Carbon dioxide, sold (dry ice) is used, the outer packaging must permit the release of carbon-dioxide gas. The primary receptacle and the secondary packaging must maintain their containment integrity at the temperature of the refrigerant used as well as at the temperatures and pressure(s) of air transport to which the receptacle could be subjected if refrigeration were to be lost.

Substances shipped in liquid nitrogen: Plastic primary receptacles capable of withstanding very low temperatures must be used. Secondary packaging must also withstand very low temperatures and in most cases will need to be fitted over individual primary receptacles. Requirements for shipment of liquid nitrogen must also be observed. The primary receptacle must maintain its containment integrity at the temperature of the refrigerant used as well as at the temperatures and pressure(s) of air transport to which the receptacle could be subjected if refrigeration were to be lost. Where multiple primary receptacles are contained in a single secondary packaging, they must be separated and supported to ensure that contact between them Is prevented.

Lyophilized substances: Primary receptacles must be either flame-sealed glass ampoules or rubber-stoppered glass vials with metal seals.

What is claimed is:

1. A container system, comprising:

a soft-sided outer shell, said outer shell comprising a plurality of vertical walls and bottom integrally formed and having an inner layer formed of watertight material, said vertical walls and bottom forming an open top which is covered by a lid adapted to be selectively secured to said vertical walls, wherein said outer shell is at least partially collapsable by an unorganized reduction in volume when unsupported; and an inner frame having rigid walls;

wherein said inner frame is adapted to support said outer shell when said inner frame is inserted inside said outer shell;

wherein said inner frame is at least partially collapsable.

2. The container system according to claim 1, further comprising hazardous material positioned within said outer shell.

3. The container system according to claim 2, wherein said hazardous material includes an organ.

4. The container system according to claim 1, wherein said outer shell satisfies IATA 602 requirements for an outer packaging when supported from within by said inner frame.

5. The container system according to claim 1, wherein said soft-sided outer shell includes vent holes.

6. The container system according to claim 1, further comprising a fastener to secure said lid to said vertical walls.

7. The container system according to claim 6, wherein said fastener is a zipper.

8. The container system according to claim 1, wherein said bottom is structurally reinforced.

9. The container system according to claim 1, wherein said outer shell includes an outer fabric layer and foam insulation for thermally insulating an interior of said shell from an external environment.

10. The container system according to claim 9, wherein said outer fabric includes polyester.

11. The container system according to claim 1, wherein said inner frame comprises:

a pair of opposing, rigid longitudinal walls; and a pair of opposing, collapsable side walls, each of said side walls linking an end of one of said longitudinal walls to an end of the other of said longitudinal walls, said side walls adapted to collapse to allow a reduction in a distance between said longitudinal walls.

12. The container system according to claim 11, wherein said inner frame further comprises:

a rigid bottom pivotably engaged to one of said pair of opposing rigid walls, said rigid bottom adapted to selectively pivot between a first open position and a second collapsed position.

13. The container system according to claim 11, wherein said inner frame further comprises a fastener to secure said side walls in a collapsed position.

14. The container system of claim 1, wherein said outer shell is capable of withstanding an internal pressure which produces a pressure differential of not less than 95 kPa (0.95 bar, 13.8 lb/in$^2$) in the range or −40° C. to +55° C. (−40° F. to 130° F.).

15. A method of transporting hazardous material, comprising:

providing a container system according to claim 1; and positioning hazardous material into said container system.

16. The method according to claim 15, wherein said hazardous material includes an organ.

17. The method according to claim 15, wherein said container system satisfies IATA 602 requirements for an outer packaging.

18. The method according to claim 15, wherein said soft-sided outer shell of said container system includes vent holes.

19. The method according to claim 15, further comprising:

removing said hazardous material from said container system; and collapsing said container system.

20. A method of transporting hazardous material, comprising:

providing a container system according to claim 1; and inserting said inner frame into said outer shell; and positioning hazardous material into said outer shell in an assembled configuration.

21. The method according to claim 20, wherein said hazardous material includes an organ.

22. The method according to claim 20, further comprising:

removing said hazardous material from said outer shell;

removing said inner frame from said outer shell;

collapsing said inner frame; and collapsing said outer shell.

23. The method according to claim 20, wherein said inserting said inner frame into said outer shell satisfies IATA 602 requirements for an outer packaging.

24. The method according to claim 20, wherein said soft-sided outer shell of said container includes vent holes.

25. A container system, comprising:

a soft-sided outer shell, said outer shell comprising a plurality of vertical walls and bottom integrally formed and having an inner layer formed of watertight material, said vertical walls and bottom forming an open top which is covered by a lid adapted to be selectively secured to said vertical walls, wherein said outer shell is at least partially collapsible by an unorganized reduction in volume when unsupported; and an inner frame having a pair of opposing, rigid longitudinal walls and a pair of opposing side walls;

wherein each of said opposing side walls links an end of one of said longitudinal walls to an end of the other of said longitudinal walls, wherein each of said side walls comprises a vertical crease to allow a reduction in a distance between said longitudinal walls; and wherein said inner frame is adapted to support said outer shell when said inner frame is inserted inside said outer shell.

26. The container system according to claim 25, wherein said inner frame further comprises a rigid bottom pivotably engaged to one of said pair of opposing rigid walls, said rigid bottom adapted to selectively pivot between a first open position and a second collapsed position.

27. The container system according to claim 25, wherein said inner frame further comprises a fastener to secure said side walls in a collapsed position.

28. The container system according to claim 25, wherein said outer shell satisfies IATA 602 requirements for an outer packaging when supported from within by said inner frame.

29. The container system of claim 25, wherein said outer shell is capable of withstanding an internal pressure which produces a pressure differential of not less than 95 kPa (0.95 bar, 13.8 lb/in$^2$) in the range or −40° C. to +55° C. (−40° F. to 130° F.).

* * * * *

UNITED STATES PATENT AND TRADEMARK OFFICE

CERTIFICATE OF CORRECTION

PATENT NO. : 7,775,388 B2
APPLICATION NO. : 10/629322
DATED : August 17, 2010
INVENTOR(S) : Murrer It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 901 days.

Signed and Sealed this
Twenty-second Day of March, 2011

David J. Kappos

David J. Kappos
*Director of the United States Patent and Trademark Office*